US007441693B2

(12) United States Patent
Liao

(10) Patent No.: US 7,441,693 B2
(45) Date of Patent: Oct. 28, 2008

(54) HANDLE STRUCTURE FOR CARTONS

(75) Inventor: Shu-Ju Liao, Taipei Hsien (TW)

(73) Assignee: Qisda Corporation, Shan-Ting Tsun, Gueishan Hsiang, Taoyuan County (TW)

( * ) Notice: Subject to any disclaimer, the term of this patent is extended or adjusted under 35 U.S.C. 154(b) by 0 days.

(21) Appl. No.: 11/657,574

(22) Filed: Jan. 25, 2007

(65) Prior Publication Data

US 2007/0175970 A1 Aug. 2, 2007

(30) Foreign Application Priority Data

Jan. 27, 2006 (TW) ..... 95103605 A

(51) Int. Cl.
*B65D 5/46* (2006.01)

(52) U.S. Cl. ..... 229/117.19; 229/117.23; 229/117.24

(58) Field of Classification Search ..... 229/117.19, 229/117.23, 117.24; 220/759, 762, 768, 220/770, 775, 776
See application file for complete search history.

(56) References Cited

U.S. PATENT DOCUMENTS

RE20,428 E * 6/1937 Kells ..... 229/117.19
2,458,883 A * 1/1949 Trogman ..... 229/117.24
2,612,401 A * 9/1952 Simmonds ..... 229/117.19
2,853,224 A * 9/1958 Slater et al. ..... 229/117.24
3,176,326 A * 4/1965 Zysman et al. ..... 220/770
4,176,423 A * 12/1979 Wigemark ..... 229/117.19
5,137,209 A * 8/1992 Roberts et al. ..... 229/117.25
6,014,850 A * 1/2000 LeMire ..... 220/759
6,540,133 B1 * 4/2003 Chou ..... 220/770

FOREIGN PATENT DOCUMENTS

GB 2218690 A * 11/1989 ..... 229/117.24

* cited by examiner

*Primary Examiner*—Gary E Elkins
(74) *Attorney, Agent, or Firm*—Winston Hsu

(57) ABSTRACT

A handle structure for cartons has a handle body and two symmetrical fastening pairs disposed at two ends of the handle body. Each fastening pair includes an inside L frame, an outside L frame, and a flexible ligament connecting the inside L frame and the outside L frame. While the locations of the inside L frame and the outside L frame are shifted through the flexible ligament, the inside fastening strip of the inside L frame and the outside fastening strip of the outside L frame can adjoin closely. Moreover, the inside unfolded strip of inside L frame and the outside unfolded strip of the outside L frame are led to a status as two wings spanned in parallel at both sides of the flexible ligament.

7 Claims, 5 Drawing Sheets

HANDLE STRUCTURE FOR CARTONS

BACKGROUND OF THE INVENTION (1) Field of the Invention

The invention relates to handle structures of cartons, specifically to such a handle structure with an all-in-one configuration and easily being assembled.

(2) Description of the Prior Art

As to conventional methods of carrying cartons (normally for the cartons accommodating lighter things), the popular ways are bound with ropes, carried by another bag, or held by the handle provided by cartons themselves. Here, the more convenient way is using the handle provided by carton itself. The object of the present invention relates to the carrying tool of the type of handles provided by cartons themselves.

Please refer to FIG. 9, showing a schematic section view of joining a conventional handle structure 20 on the top 101 of a carton. Normally, the handle 20 is a symmetric structure of all-in-one module and each of its two ends have a respective hook 202, so that, after the handle 20 has been assembled at a corresponding opening 103 on the carton, a lift force F can block the handle 20 under the top 101 of the carton and lead to an effective structure for a handle of carton.

However, in conventional structures, when the lift force F is applied to the handle 20, because of the configuration of the handle 20, the contact with carton normally occurred at the two anti-force points, PA, as shown in the figure. Furthermore, the factor that anti-force is concentrated and the strength of carton is limited (particularly, the intensity for bending near opening 103) makes the whole structure strength of joining carbon and handle insufficient, thereby the opening 103 of carton is prone to chronic deformation. As time elapses, either the opening 103 breaks or the end of the handle 20 is slipped off the opening 103 because the opening 103 is gradually deformed.

Hence, in conventional handle structures for cartons, the maximum lift force F (proportional to weight accommodated in the carton) will decrease gradually day by day.

SUMMARY OF THE INVENTION

The main goal of the present invention is to provide a handle structure for cartons, which uses the active joint structure of handle ends to distribute the exerted force uniformly over the whole end after the handle is assembled on the carton. Thereby, the integrity of the opening structure can be formed and a maximum load for the carton can be guaranteed.

The handle structure of the carton in the present invention comprises a handle body, two symmetrical fastening pairs disposed at two ends of the handle body.

The handle body of the present invention is a longitudinal strip, or a structure like a band.

Each fastening pair of the present invention can include an inside L frame, an outside L frame, and a flexible ligament flexibly connecting the inside L frame and the outside L frame.

The inside L frame is a two-arm structure in L shape where one arm is an inside fastening strip connected to the handle body while the other is an inside unfolded strip connected to the inside fastening strip. In addition, the inside fastening strip has at least one inside fastening part, and the junction of the inside fastening strip and the inside unfolded strip is defined an inside edge of frame corner (i.e., the outside edge of the corner at the center of the inside L frame).

The outside L frame is a two-arm structure in L shape, a mapped form from the inside L frame where one arm is an outside fastening strip and the other is an outside unfolded strip connected to the outside fastening strip. In addition, the outside fastening strip has at least one outside fastening part and the junction of the outside fastening strip and the outside unfolded strip is defined an outside edge of frame corner (i.e., the outside edge of the corner at the center of the inside L frame).

The flexible ligament of the present invention, connecting the inside edge of frame corner on the inside L frame and the outside edge of frame corner on the outside L frame, makes the outside L frame swingable to the inside edge of frame corner through the joint, a flexible ligament.

In the present invention, when the positions of the inside L frame and the outside L frame are shifted through the flexible ligament, the inside fastening part on the inside fastening strip and the corresponding outside fastening part on the outside joining strip fasten and fix. At the same time the outside fastening strip and the inside fastening strip meet and fit closely, while the inside unfolded strip and the outside unfolded strip extend as two parallel spanning wings at both sides of the flexible ligament.

In a preferred embodiment of the present invention, the inside fastening part on the inside fastening strip and the outside fastening part on the outside fastening strip can be configured as a projective pin button and a hole for being passed by a projective pin button, respectively.

In a preferred embodiment of the present invention, the inside fastening part on the inside fastening strip and the outside fastening part on the outside fastening strip can be configured as a hole and a projective pin button passing the hole to appear a fixed status.

In order to let committee members may have a further understanding and approval of the present invention, a detailed description along with figures is illustrated as follows.

DESCRIPTION OF THE PREFERRED EMBODIMENT

Figure 1:
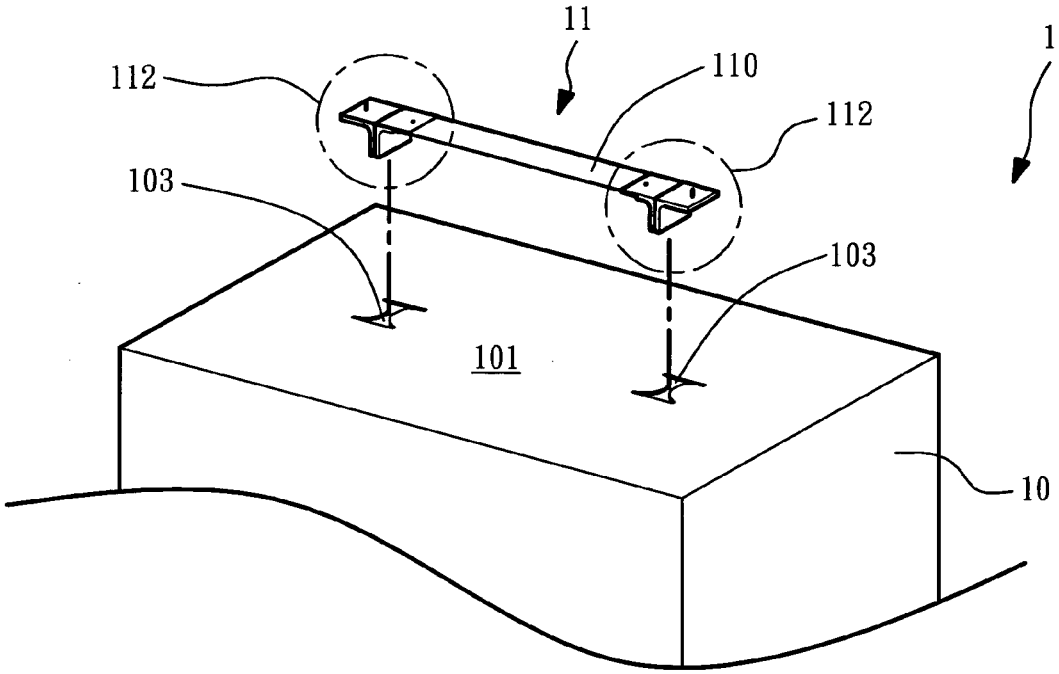
FIG. 1 shows a perspective view of a preferred embodiment of the handle structure of a carton in accordance with the present invention along with the carton before being joined.

In the following description, for the consistency of technical explanation in the present invention, if in different embodiments there exist parts with same function but minor different in shape, they are named with the same terms and reference numerals.

Figure 2:
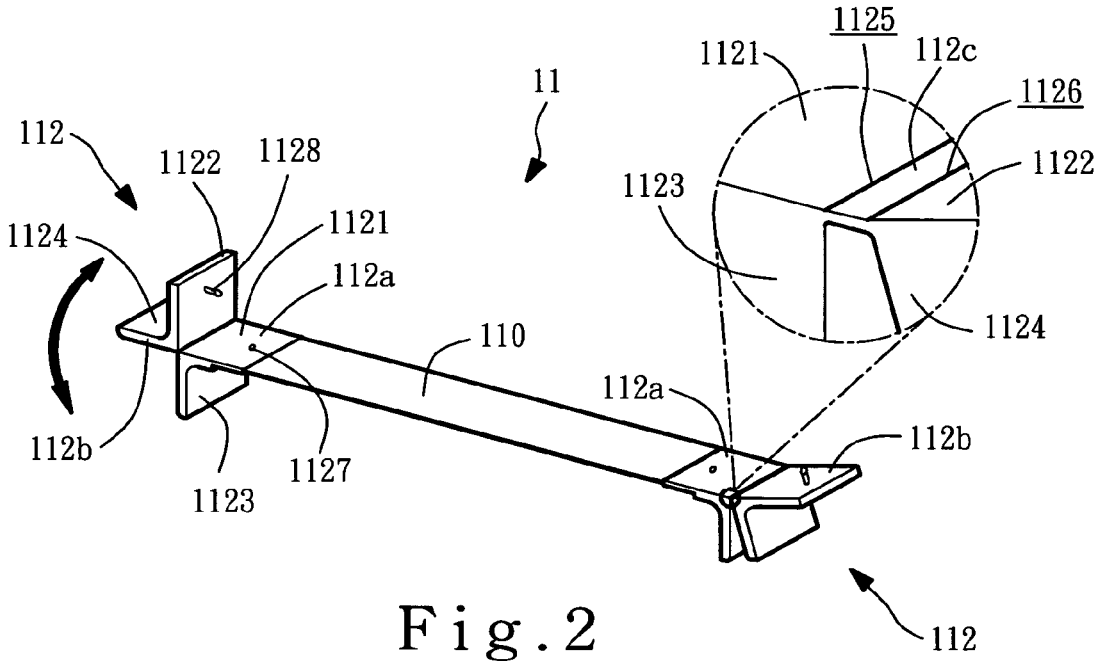
FIG. 2 shows a perspective view of the handle structure in FIG. 1.

Please refer to FIG. 1 and FIG. 2, showing respectively a perspective view before a preferred handle structure 11 is joined to a carton 1, and a perspective view of the handle structure in FIG. 1. The handle structure 11 in FIG. 1 and in FIG. 2 is under different states.

The handle structure 11 of the present invention, disposed on the carton 1 as a carrying tool for the carton 1, comprises a handle body 11, two symmetrical fastening pairs 112 at two ends of the handle body 110.

The handle body 110 formed as a longitudinal strip or a band structure is the portion of the handle structure 11 for a lifting force to be applied.

The fastening pair 112, disposed at the corresponding opening 103 for assembly on the top surface 101 of the carton 1, is used for the handle structure 11 to be fixed on the frame structure of the carton 1. Each fastening pair 112 can include an inside L frame 112*a*, an outside L frame 112*b*, and a flexible ligament 112*c* connecting the inside L frame 112*a* and the outside L frame 112*b*.

As to the inside L frame 112*a*, a preferred one is a two-arm body structure in L shape, where one arm is an inside fastening strip 1121 connecting to the handle body 110 and the other is an inside unfolded strip 1123 connecting to the inside fastening strip 1121 (or an extension of the inside fastening strip 1121 in perpendicular). The fastening strip 1121 has at least one inside fastening part 1127 (as shown in the figure, an inside fastening part 1127). In addition, the junction between the inside fastening strip 1121 and the inside unfolded strip 1123 (i.e., the outside edge of corner at the center of the inside L frame 112*a*) is defined as an inside edge of the frame corner 1125.

The outside L frame 112*b* is an two-arm structure in L shape mapped from the inside L frame 112*a*, where one arm is an outside fastening strip 1122 and the other is an outside unfolded strip 1124 fixedly connecting to the outside fastening strip 1122 (or perpendicularly extending from the outside fastening strip). Here, the outside fastening strip 1122 may be equipped at least one outside fastening part 1128 (as shown in the figure is an inside fastening part 1127) and the junction between the outside fastening strip 1122 and the outside unfolded strip 1124 (i.e., the outside edge of the corner at the center of the outside L frame 112*b*) is defined as an outside edge of the frame corner 1126.

The flexible ligament 112*c* of the present invention, connecting the inside edge of the frame corner 1125 on the inside L frame 112*a* and the outside edge of the frame corner 1126 on the outside frame L 112*b*, based on the feature of its flexibility, makes the outside frame L 112*b* swingable to the inside edge of the frame corner 1125 (similar to a pivotal motion or a joint motion). In FIG. 2, the fastening pairs 112 at both ends of the handle structure 2 represents a different state of rotation angle from that of the fastening pairs 112 in FIG. 1.

As shown in FIG. 1, when the inside unfolded strip 1123 of the inside frame L 112*a* and the outside unfolded strip 1124 of the outside frame L 112*b* fit closely, two outside fastening strips 1122 and two inside fastening strips 1121 of the handle structure and handle body 110 represent an analogous state of a continuous connection plane.

When the positions between the inside frame L 112*a* and the outside frame L 112*b* shift through the flexible ligament 112*c*, the inside fastening part 1127 at the inside fastening strips 1121 is matched and joined to its corresponding outside fastening part 1128 at the outside fastening strip 1122. At present, the outside fastening strip 1122 and the inside fastening strip 1127 fit closely and the inside unfolded strip 1123 and the outside unfolded strip 1124 extend as two parallel spanning wings at two sides of the flexible ligament 112*c*.

In the embodiment as shown in the figure, the inside fastening part 1127 on the inside fastening strip 1121 and the outside fastening part 1128 on the outside fastening strip 1122 can be a projective pin button and a hole for being passed by the projective pin button.

Please refer to FIG. 3, FIG. 4, FIG. 5, and FIG. 6, showing the section views for four sequential operations for assembling the handle structure 11 on the carton 1. These four drawings illustrate how to install a fastening pair 112 in the opening 103 on a top surface 110 of the carton 1. For a clear illustration, the fastening pair 112 at the left side of the handle structure 11 is taken as an example.

Figure 3:
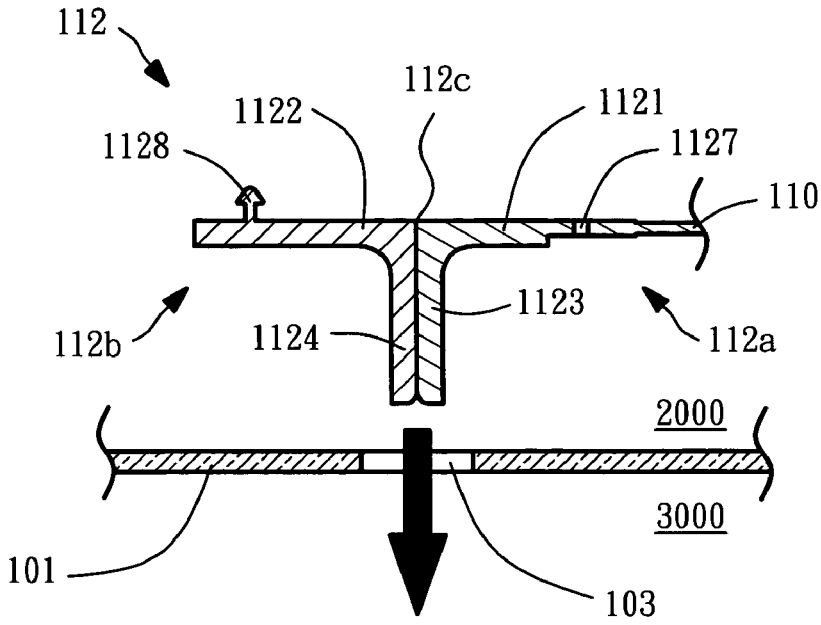
FIG. 3 shows a section view of an operating state (first of the four continuous states) for assembling the handle on the carton.

In FIG. 3, the fastening pair 112 and the assembling opening 103 on the top surface 101 of the carton are separated without connecting. That is, the entire fastening pair 112 is at the outside 2000 of the top 101. Now, the inside unfolded strip 1123 of the inside L frame 112*a* and the outside unfolded strip 1124 of the outside L frame 112*b* fit closely and point downwards to the opening 103 while the inside fastening strip 1121 on the inside L frame 112*a* and the outside fastening strip 1122 on the outside L frame L 112*b* form as two spanning wings in parallel at two sides of the flexible ligament 112*c*.

Figure 4:
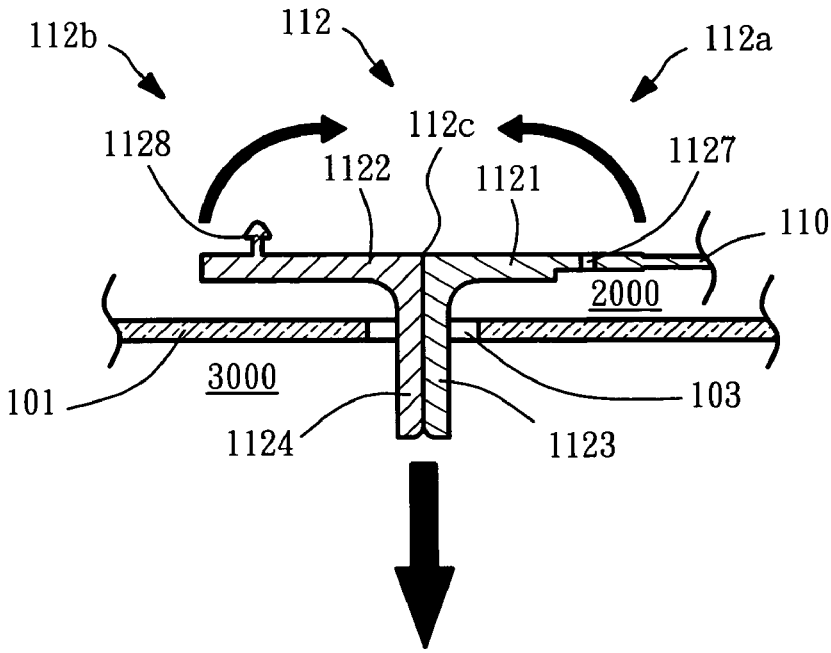
FIG. 4 shows a section view of another operating state (the second of four continuous states) for assembling the handle on a carton.

In FIG. 4, the fastening pair 112 is sent to have the inside unfolded 1123 and the outside unfolded 1124 entering the opening 103.

Figure 5:
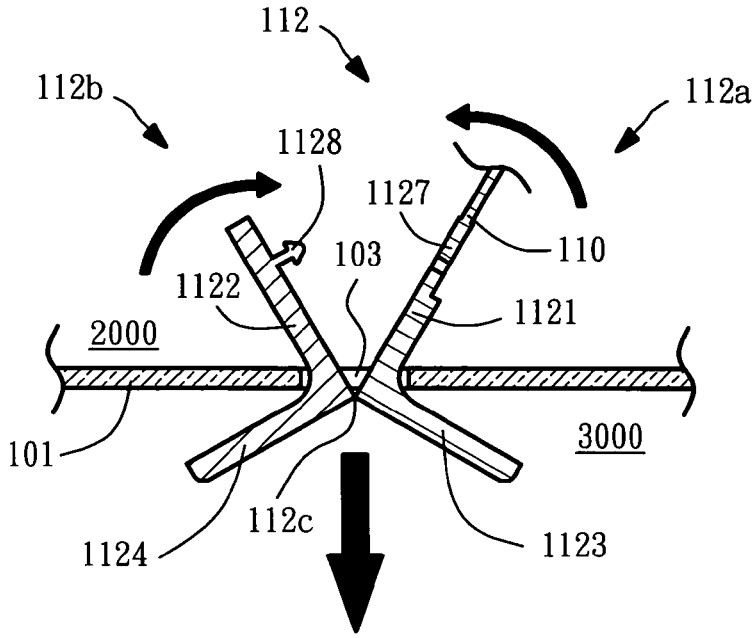
FIG. 5 shows a section view of a further operating state (the third of four continuous states) for assembling the handle on a carton.

While the inside fastening strip 1121 and the outside fastening strip 1122 of the fastening pair 112 enter the opening 103 further, then the inside fastening strip 1121 and the outside fastening strip 1122 at both sides of the flexible ligament 112*c* can be lifted with a motion as if two wings are to be closed (such as the moving direction shown in FIG. 4 and FIG. 5). This makes the middle bending part (the structure near flexible ligament 112*c*) of the inside L frame 112*a* and the outside L frame 112*b* smoothly move downwards and pass the assembling opening 103, and leads the inside unfolding strip 1123 and the outside unfolding strip 1124 gradually and completely to the inside 3000 under the top 101 of the carton.

Figure 6:
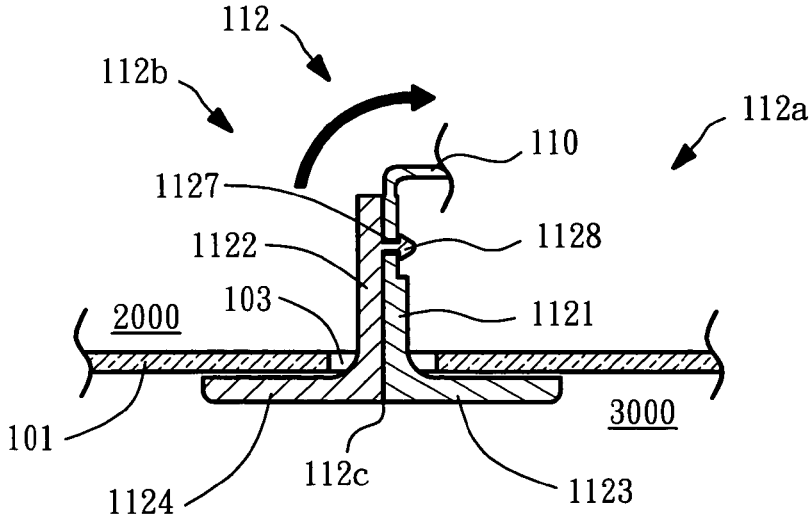
FIG. 6 shows a section view of a completed operating state (the fourth of four continuous states) for assembling the handle on a carton.

As shown in FIG. 6, after the inside unfolding strip 1123 and the outside unfolding strip 1124 are completely disposed at the inside 3000 on the top 101 of carton, the inside fastening strip 1121 and outside fastening strip 1122 are closely overlapped by fixedly joining the inside fastening part 1127 and its corresponding outside fastening part 1128. Then, the inside unfolding strip 1123 and the outside unfolding strip 1124 form two continuous strips disposed inside 3000 of the top 101.

After finishing the joining steps as shown from FIG. 3 to FIG. 6 for the fastening pair 112 at two ends of the handle structure 11, the assembly of installing the handle structure 11 on the carton 1 has finished. Now, the inside fastening strip 1121 on the inside L frame 112*a* and the outside fastening strip 1122 on the outside L frame 112*b* fit closely and pass through the opening 103, and the inside unfolding strip 1123 and the outside unfolding strip 1124 form a status of two continuous strips constrained to be disposed at the inside

3000 of the top 103 (that is, they are extended as the status of two parallel spanning wings at both sides of the flexible ligament 112*c*).

Figure 7:
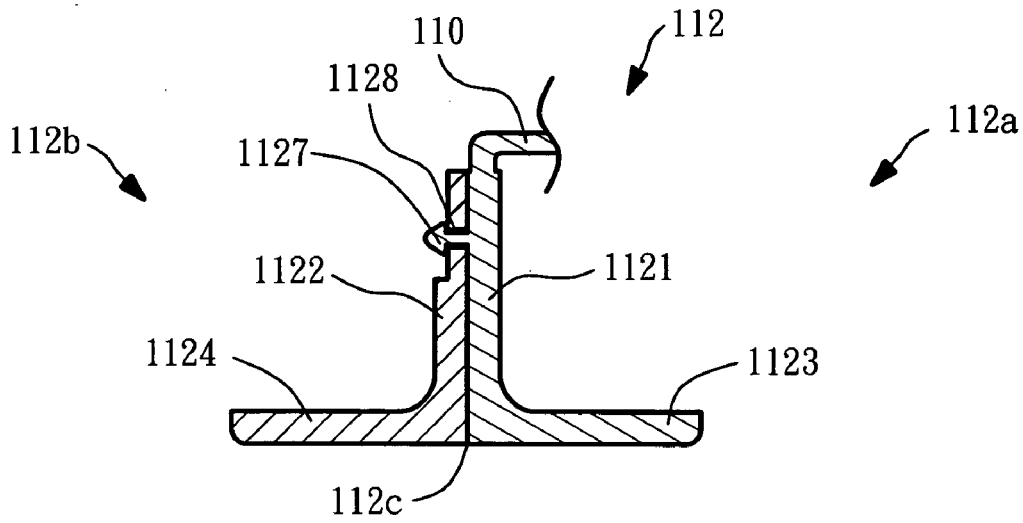
FIG. 7 shows a section view of one side of the fastening pair for another embodiment of the handle structure for the carton of the present invention.

Please refer to FIG. 7, a section view of the fastening pair 112 at one side of another embodiment for the handle structure 11 on the carton 1 of the present invention. The difference in the embodiment from earlier ones is that the inside fastening part 1127 on the inside fastening strip 1121 and the outside fastening part 1128 on the outside fastening strip 1122 are a hole and a projective inserting part passing through the hole with a fixedly joining status (merely contrary to the structure of the above embodiment), respectively.

Figure 8:
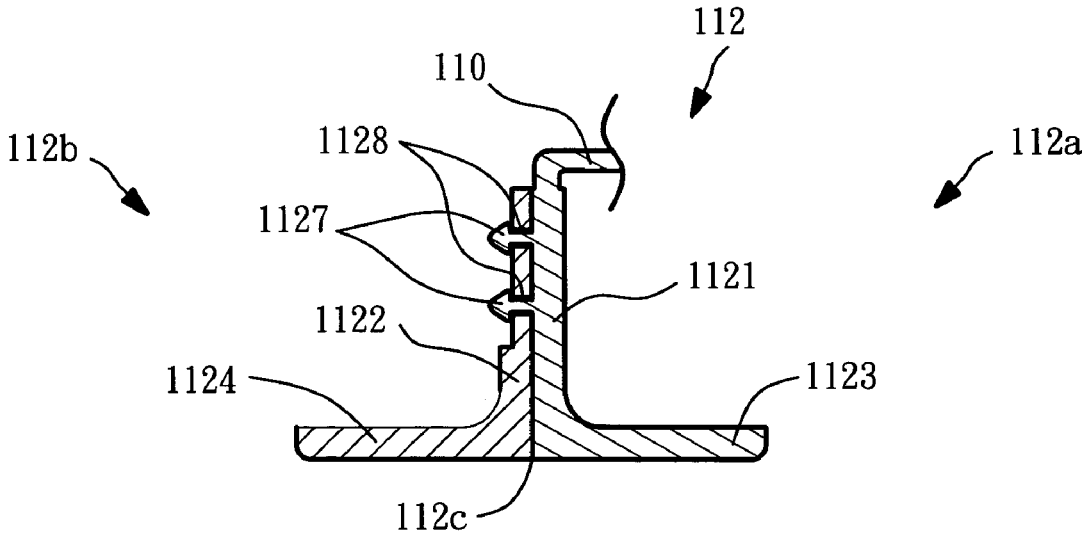
FIG. 8 shows a section view of one side of the fastening pair for the other embodiment of the handle structure for the carton of the present invention.
Figure 9:
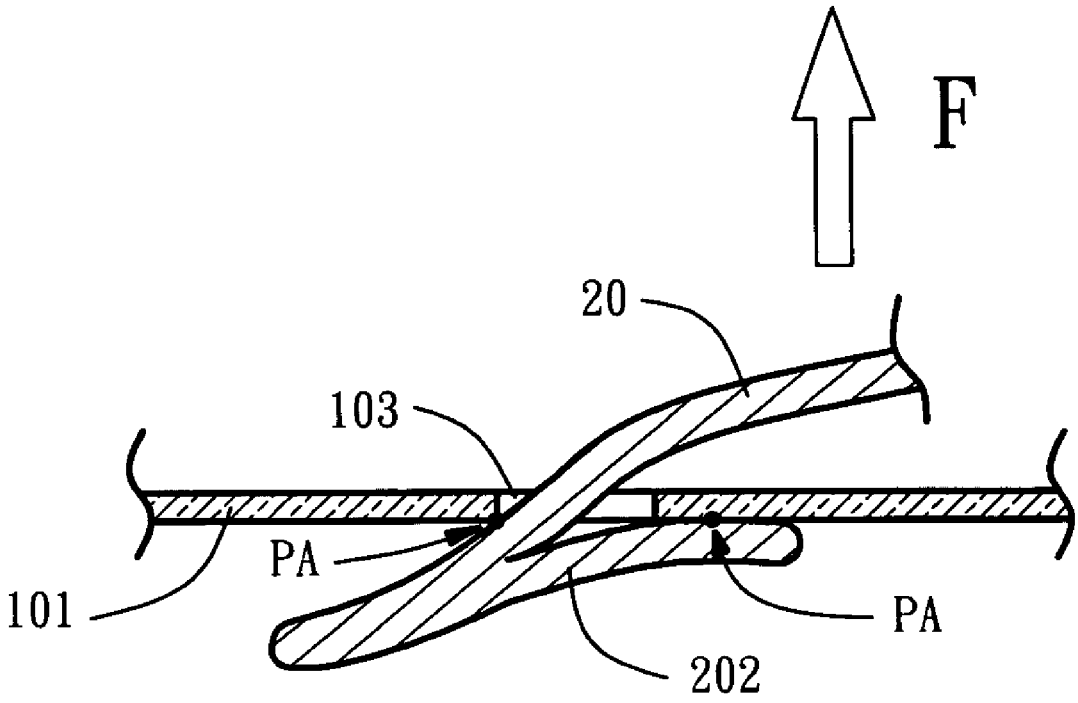
Fig. 9 (Prior Art)
FIG. 9 shows a section view of one side of the conventional handle structure for the carton.

Please refer to FIG. 8, showing a section view of the fastening pair 112 at one side of another embodiment for the handle structure 11 of the carton 1 of the present invention. The difference in FIG. 8 from that of the embodiment in FIG. 7 is that two sets of the same combination of the inside fastening part 1127 and the outside fastening part 1128 in FIG. 7.

In the present invention, the handle structure 11 is preferred to be adopted as an all-in-one structure. However, under certain situations, the inside unfolded strip 1123 and the outside unfolded strip 1124 can be fabricated separately, and then be fixedly joined when assembling the inside fastening strip 1121 and the outside fastening strip 1122, respectively. Under this situation, the original design of a flexible ligament can be eliminated.

With the structure of the fastening pair 112 at ends of the handle structure 11 of the present invention, after the handle 11 is assembled on the carton, lifting force can be distributed uniformly to the inside unfolded strip 1123 and outside unfolded strip 1124 at ends of the handle 11. Thereby, this leads to not only holding the integrity of structure but also keeping the capability of bearing the maximum load for the carton for a longer time.

The above description employing a preferred embodiment to illustrate the present invention in details, yet not to be construed as limiting the scope of the invention. Those experts on this technology should realize that any equivalent embodiment or minor modification will not exempt from infringing the object of the present invention and should be included within the scope of this patent application.

I claim:

1. A handle structure for cartons, comprising:

a handle body, formed as a longitudinal strip structure; and two fastening pairs, connecting to two respective ends of said handle body, each said fastening pair further including:

an inside L frame, formed as an L-shape two-arm structure, including an inside fastening strip connected to said handle body, and an inside unfolding strip, where said inside fastening strip is equipped with at least one inside fastening part, where a junction of said inside fastening strip and said inside unfolding strip is defined as an inside edge of frame corner;

an outside L frame, formed as another L-shape two-arm structure shaped symmetrically with said inside L frame, including an outside fastening strip and an outside unfolding strip, where at least one outside fastening part is equipped on said outside fastening strip, where a junction of said outside fastening strip and said outside unfolding strip is defined as an outside edge of frame corner; and a flexible ligament, connecting said inside edge of frame corner and said outside edge of frame corner so that said outside L frame is swingable relative to said inside edge of frame corner through a use of said flexible ligament, where positions of said inside L frame and said outside L frame are shifted through said flexible ligament so as to fixedly join said inside fastening part and said corresponding outside fastening part and said outside fastening strip and said inside fastening strip fit closely and join; said inside unfolded strip and said outside unfolded strip being extended as two parallel wings spanning at both sides of said flexible ligament.

2. The handle structure for cartons of claim 1, wherein said inside fastening part and said outside fastening part are a projective pin button and a matched hole for being passed by said projective pin button, respectively.

3. The handle structure for cartons of claim 1, wherein said outside fastening part and said inside fastening part are a projective pin button and a matched hole for being passed by said projective insert, respectively.

4. A carton structure, comprising, a carton, including a top where two assemble openings are fabricated and separated with a specified distance; and a handle structure, used as a handle of said carton, including:

a handle body, formed as a longitudinal strip structure disposed at an outside of the top of the carton; and two fastening pairs, symmetrically connected to two ends of said handle body, respectively, each said fastening pair passing through a corresponding one of said openings, each said fastening pair further including:

an inside L frame, formed as an L-shape two-arm structure, including an inside fastening strip connected to said handle body and said inside L frame passing through a corresponding one of said assemble openings to have an inside unfolding strip disposed inside the carton; and an outside L frame, formed as an L-shape two-arm structure shaped symmetrically with said inside L frame, including an outside fastening strip, said outside L frame passing through a corresponding one of said assemble openings to have an outside unfolding strip disposed inside said carton, where said inside fastening part is fixedly joined with corresponding said outside fastening part so that said outside fastening strip fits said inside strip closely; said inside unfolded strip and said outside unfolded strip forming a continuous plane located inside the carton.

5. The carton structure of claim 4, wherein said inside fastening part and said outside fastening part are a projective pin button and a matched hole for being passed by said projective pin button, respectively.

6. The carton structure of claim 4, wherein said outside fastening part and said inside fastening part are a projective pin button and a matched hole for being passed by said projective pin button, respectively.

7. The carton structure of claim 4, wherein the junction of said inside fastening strip and said inside unfolded strip is defined as an inside edge of frame corner and the junction of said outside fastening strip and said outside unfolded strip is defined as an outside edge of frame corner, wherein said fastening pair also includes a flexible ligament connecting said inside edge of frame corner and said outside of frame corner.

* * * * *